United States Patent [19]

Beck, Jr. et al.

[11] Patent Number: 4,655,522

[45] Date of Patent: Apr. 7, 1987

[54] ELECTRICAL TERMINAL RECEPTACLE

[75] Inventors: Hoy S. Beck, Jr., Lexington, N.C.; Larry L. Leitzel, Harrisburg, Pa.; John R. Shoemaker, Reidsville, N.C.

[73] Assignee: AMP Incorporated, Harrisburg, Pa.

[21] Appl. No.: 685,673

[22] Filed: Dec. 24, 1984

[51] Int. Cl.[4] ..... H01R 27/00

[52] U.S. Cl. ..... 339/32 M; 339/258 R

[58] Field of Search ..... 339/32 R, 32 M, 217 S, 339/258 R, 276 T, 210 R, 210 M

[56] References Cited

U.S. PATENT DOCUMENTS

| | | | |
|---|---|---|---|
| 3,047,832 | 7/1962 | Deakin | 339/217 |
| 3,346,834 | 10/1967 | Kinkaid | 339/217 |
| 3,350,676 | 10/1967 | McFadden | 339/18 |
| 3,363,224 | 1/1968 | Gluntz | 339/258 |
| 3,711,819 | 1/1973 | Matthews | 339/217 S |
| 3,777,301 | 12/1973 | Michaels | 339/217 S |
| 3,963,302 | 6/1976 | Gourley | 339/217 S |
| 4,327,956 | 5/1982 | Sitzler | 339/258 R |
| 4,487,466 | 12/1984 | Petit et al. | 339/32 M |

FOREIGN PATENT DOCUMENTS

| | | | |
|---|---|---|---|
| 2036990 | 2/1971 | Fed. Rep. of Germany | 339/258 R |

*Primary Examiner*—Gil Weidenfeld
*Assistant Examiner*—Paula A. Austin
*Attorney, Agent, or Firm*—Katherine A. Nelson

[57] ABSTRACT

An electrical terminal receptacle is disclosed, which is adapted to electrically interconnect each of a plurality of conductors in a flexible flat cable, ribbon cable, discrete wire cable or the like to respective ones of the posts in a post header. The receptacle includes a housing having a plurality of side-by-side chambers, and a sheet metal terminal positioned within each of the chambers, with each terminal being electrically connected to one of the conductors of the cable. The terminal includes a pair of spaced-apart contact surfaces, and the housing incudes three separate rows of apertures, with one of the apertures of each row of communicating with the area between the contact surfaces of each terminal, and such that the receptacle may be mounted to the post header in any one of three possible orientations. The contact surfaces of each terminal are shaped so as to form converging surfaces to the entering post in each of the three orientations, and such that the contact surfaces are resiliently spread apart to resiliently engage the post on two sides in any one of the three orientations.

15 Claims, 13 Drawing Figures

54
55
14
18
15
27
20
25
12
17
19
30
111
11
110
10
16
28
31

34
39
52
49
37
59
5
41
38
44
47
50
5
58
36
41
42
45

11
37
58
59
6
6
36
11
37
59
11

36
58
42
44
34
59
37
42
44
47
49
38
41

58
36
41
39
52
38
44
34
47
5

49
44
39
52
41
41
45
36
6
58
5
6
50
45
56
48

11
10
24
52
24
24
22
22
22
31
28
34
30
11
30
10
30
14

20
25
24
31
27
28
15
22
16
19
30
14

55
25
20
56
31
24
11
28
15
16
14
19
30
11

ELECTRICAL TERMINAL RECEPTACLE

The present invention relates to an electrical terminal, and a receptacle incorporating a plurality of such terminals, and with the receptacle being adapted to electrically interconnect each of a plurality of conductors in a flexible flat cable, ribbon cable, discrete wire cable, or the like, to respective ones of the male posts in a post header mounted on a printed circuit board. More particulary, the present invention is related to an electrical receptacle of the described type which is characterized by the ability to mate with the post header in any one of three relative orientations.

In the assembly of printed circuit boards and other electrical circuits, it is common practice to mount a header comprising a row of posts on the board, and to connect the posts of the header to respective conductors in a flexible flat cable, ribbon cable, discrete wire cable or the like by means of a receptacle mounted at the end of the cable. However, by reason of the small size of many circuit boards, and the close proximity of adjacent components, it is often difficult to find a space in which to mount the post header and where it can also receive the mating receptacle.

It is accordingly an object of the present invention to provide an electrical terminal, and a receptacle incorporating a plurality of such terminals, and wherein the receptacle is able to significantly alleviate the problem of finding space to mount the post header and the receptacle on a circuit board.

It is a more particular object of the present invention to provide an electrical terminal and receptacle of the described type and wherein the electrical receptacle has the ability to mate with the post header in any one of three relative orientations, to thereby provide several alternative placements of the receptacle with respect to the post header, and so that the most efficient placement may be selected for a given application.

These and other objects and advantages of the present invention are achieved in the embodiment illustrated herein by the provision of an electrical terminal which comprises a metal member which includes a pair of elongate, generally flat side beams disposed in a parallel, laterally spaced-apart relationship, and with each of the beams having a contact surface located at a medial location along its length and so that the contact surfaces are laterally sligned with each other. The terminal further includes connection means interconnecting each pair of the adjacent ends of the two beams.

In the preferred and illustrated embodiment, the contact surfaces of the two side beams are indented inwardly toward each other and such that the inwardly indented contact surfaces present converging surfaces to facilitate the entry of the post in each of the three directions, and so as to cause the side beams to spring apart and resiliently engage the post upon such entry. Also, an integral tab extends longitudinally beyond one of the ends of the two side beams for electrically connecting a separate conductor thereto.

As a further aspect of the present invention, a plurality of terminals as described above may be mounted in a housing to form an electrical receptacle which is adapted to electrically connect each of a plurality of conductors in a flexible flat cable, ribbon cable, discrete wire cable or the like, to respective ones of the posts in a header composed of a row of posts, and with the receptacle being adapted to mate with the post header in any one or three relative orientations. More particulary, the housing comprises a plurality of side by side chambers, with one of the terminals being positioned in each chamber. Also, the housing includes aperture means cooperating with each of the chambers and such that the area between the two contact surfaces of each terminal is accessible by a post entering therebetween from each of three different directions.

Some of the objects and advantages of the present invention having been stated, others will appear as the description proceeds, when taken in conjunction with the accompanying drawings, in which.

Figures 1, 2, 3:
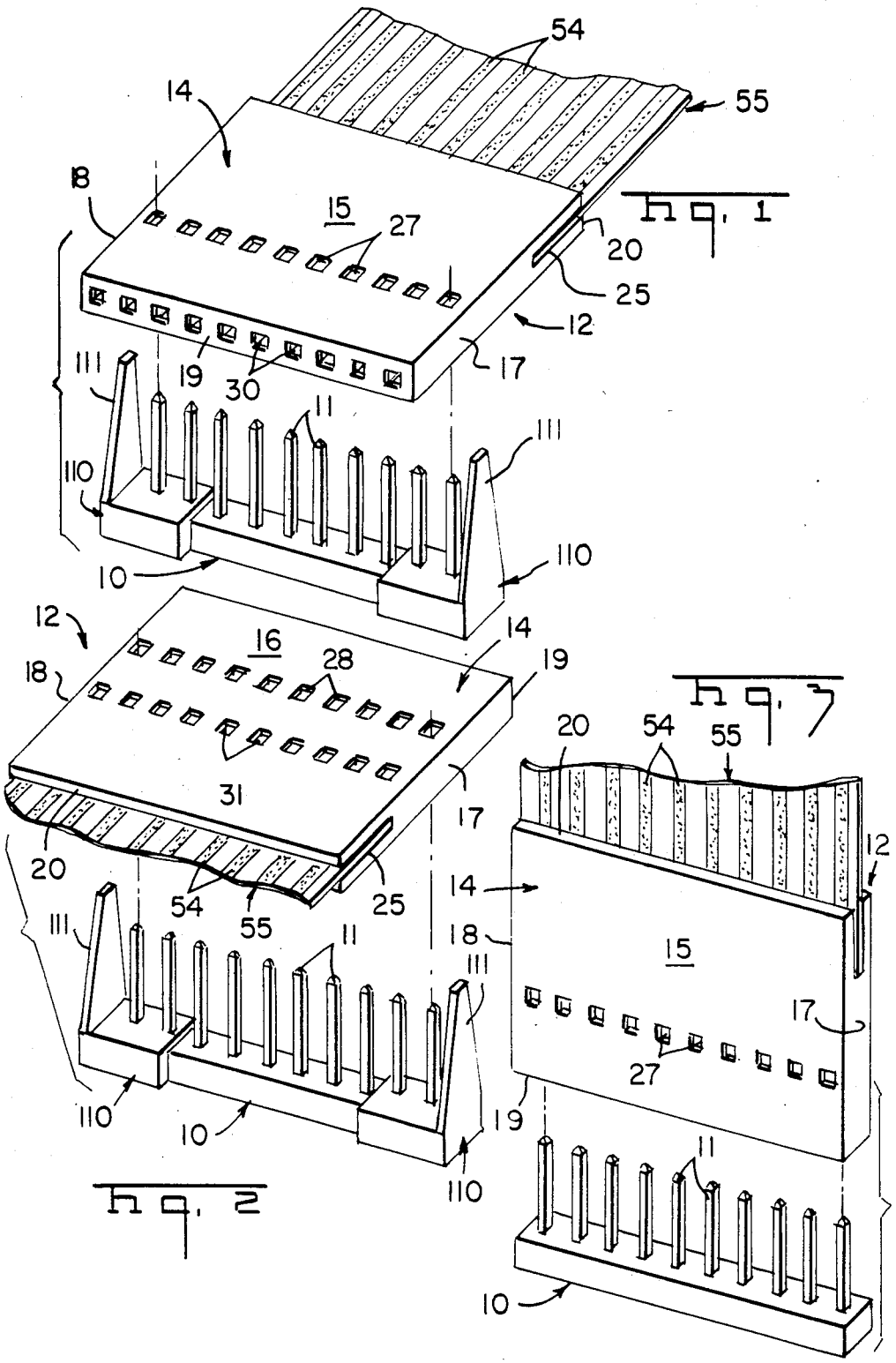
FIG. 1 is a fragmentary perspective view of a post header and mating electrical receptacle, with the components being oriented in a first selected relative position.
FIG. 2 is a view similar to FIG. 1, and with the electrical receptacle in a second possible orientation.
FIG. 3 is also similar to FIG. 1, and with the receptacle in a third possible orientation.

Referring more particularly to the drawings, FIG. 1 illustrates a post header 10 of the type conventionally mounted to printed circuit boards, and which comprises a single row of electrical posts 11. The posts 11 are adapted to be individually soldered to the electrical conductors on the circuit board in a conventional manner.

FIG. 1 further illustrates the use of optional guiding means 110, which are attached to one or both ends of post header 10. The guiding means as illustrated in FIGS. 1 and 2 has guide fingers 111 which extend upwardly from header 10 and are essentially parallel to electrical posts 11. These fingers are used to guide the receptacle into position for engagement with the electrical posts 11.

The receptacle of the present invention is generally illustrated at 12, and it comprises a housing 14 formed of a suitable insulating plastic material, and which has a generally flat, rectangular outline. More particularly, the housing includes upper and lower flat side walls 15 and 16 respectively, opposite side walls 17 and 18, a front end wall 19, and a rear end 20. The interior of the housing is divided by the interior walls 22 to form a plurality of side-by-side enclosed chambers 24 of generally rectangular cross section, and which extend longitudinally between the front end wall 19 and the rear end 20, which is open. The walls 22 between the chambers are slotted at 25 in a common plane adjacent the rear end 20, as best seen in FIGS. 9 and 10, and for the purposes described below.

The housing 14 of the present invention further includes four rows of apertures extending laterally across its width, with the two rows 27 and 28 extending through the walls 15 and 16 respectively. The apertures of these rows are transversely aligned with each other and so that the apertures of each row communicate with respective ones of the chambers 24. A third row of apertures 30 extends longitudinally through the front end wall 19 of the housing, with each of these apertures communicating longitudinally with respective ones of the chambers 24. A fourth row of apertures 31 is positioned parallel to the second row 28 on the lower flat side wall 16, with these apertures 31 also communicating in the transverse direction with respective ones of the chambers 24.

Figure 9:
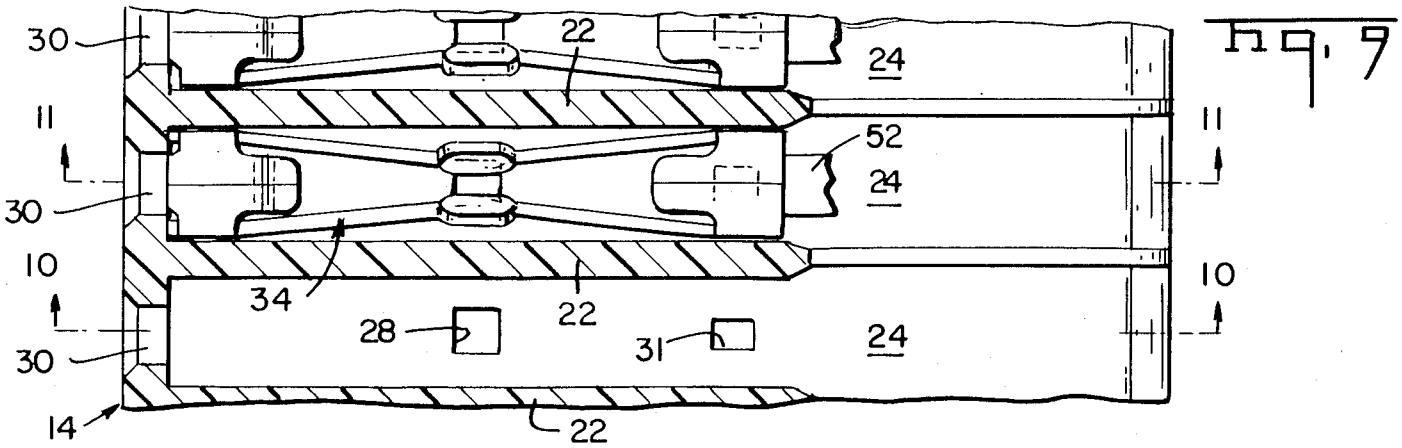
FIG. 9 is a fragmentary sectional plan view of the interior of the receptacle.
Figure 10:
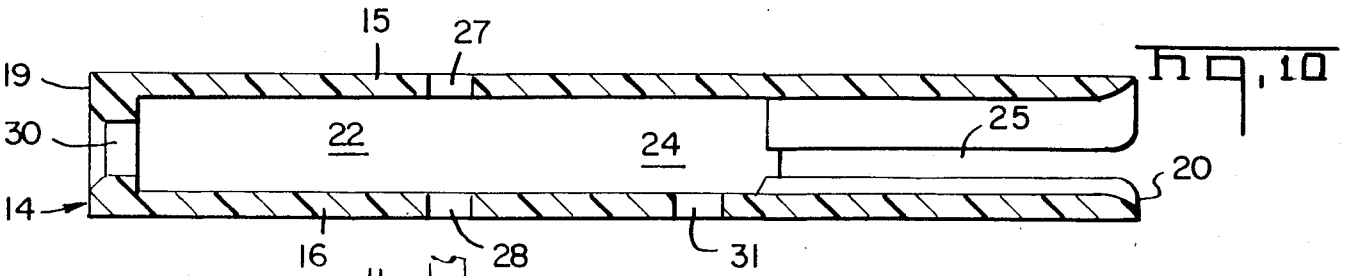
FIG. 10 is a sectional side elevation view taken substantially along the line 10—10 of FIG. 9, with the terminal omitted for clarity of illustration.
Figure 11:
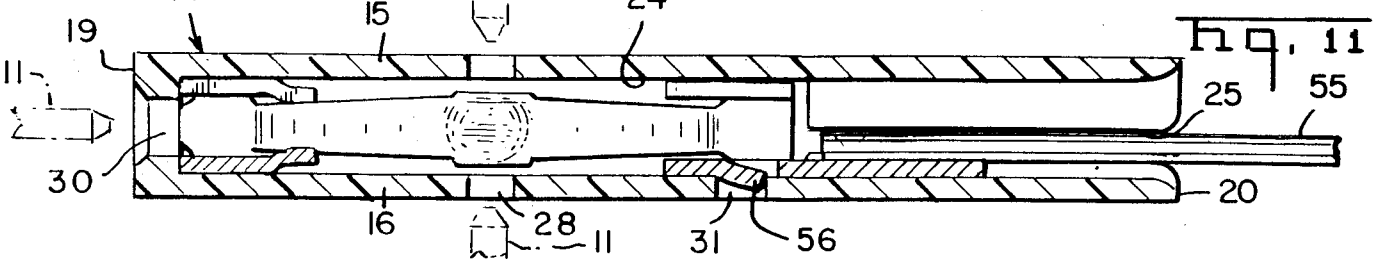
FIG. 11 is a sectional side elevation view taken substantially along the line 11—11 of FIG. 9.

An electrical terminal 34 is mounted within each of the chambers 24 of the housing 14 in the manner best seen in FIGS. 9 and 11. As is illustrated in FIGS. 4 through 8, each terminal 34 comprises a formed sheet metal member which includes a pair of elongate, generally flat side beams 36, 37 disposed in a parallel, laterally spaced-apart relationship, and so as to define a lateral direction extending between the side beams, a longitudinal direction which is parallel to the elongate direction of the side beams, and a transverse direction which is perpendicular to the longitudinal direction and to the lateral direction.

Each terminal 34 further comprises integral connection means interconnecting each pair of adjacent ends of the two side beams. This connection means comprises an open box-like end section 38 or 39 at each end of the pair of beams, and with each end section being composed of a first pair of opposite side walls 41, 42 which are coextensive with the side beams 36, 37 respectively, and a second pair of opposite side walls 44, 45. The end section 38 which is adjacent the front end wall 19 includes a rearwardly and longitudinally directed tongue 47 extending from the side wall 44, and a similar tongue 48 extending from the side wall 45. Also, these tongues 47, 48 are deformed inwardly toward each other. The opposite end section 39, which is disposed at a medial location within the longitudinal length of the chamber 24 when assembled in the housing 14, also includes two tongues 49, 50 extending longitudinally toward the opposite end section 38.

Each terminal 34 further comprises an integral tab 52 extending longitudinally and rearwardly from the side wall 45 of the end section 39. The tab 52 of each terminal 34 is adapted to be electrically connected to one of the conductors 54 of a flat flexible cable 55, ribbon cable, discrete wire cable or the like, by means of crimping, soldering, or other conventional procedure. Also, a portion of the side wall 45 of the end section 39 is deflected outwardly to form a retention spring tab 56, note FIGS. 8 and 11.

Each of the side beams 36, 37 includes a contact surface 58, 59 respectively, which is located at a medial location along its length and so that the contact surfaces are laterally aligned with each other. The two contact surfaces 58, 59 are also indented inwardly toward each other, and such that the area between the two contact surfaces is accessible by a post 11 entering therebetween from a longitudinal direction (note FIG. 6) or by a post entering from either one of the two transverse directions (note FIG. 5). The contact surfaces 58, 59 will be seen to present converging surfaces to facilitate the entry of the post 11 in each of these three directions, and to cause the side beams 36, 37 to spring apart and resiliently engage opposite sides of the post upon such entry.

Figures 4, 5, 6, 7, 8:
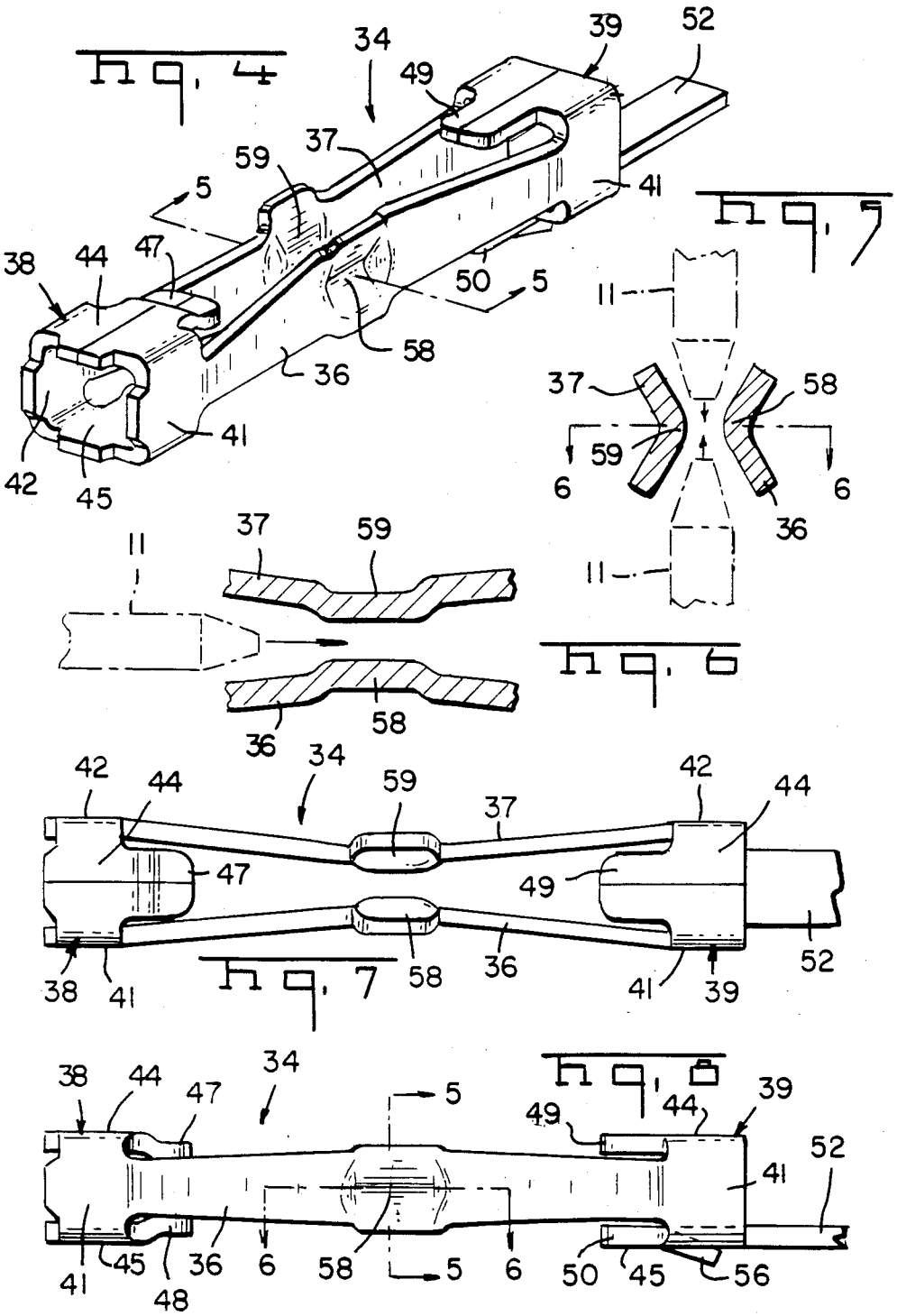
FIG. 4 is a perspective view of one of the terminals of the receptacle shown in FIG. 1.
FIG. 5 is a fragmentary sectional view taken substantially along the line 5—5 of FIG. 4.
FIG. 6 is a transverse sectional view taken substantially along the line 6—6 of FIG. 5.
FIGS. 7 and 8 are top plan and side elevation view of the terminal, respectively.

As best seen in FIGS. 7 and 9, each of the side beams 36, 37 has a slightly V-shaped configuration when viewed in a transverse direction, with the V-shaped configuration of the two side beams being oriented oppositely with respect to each other. Also, the contact surfaces 58, 59 will be seen to be disposed at the bights of the V-shaped configuration. This arrangement facilitates the flexibility of the beams, and the ability of the beams to flex outwardly away from each other and resiliently engage the post 11 upon its entry therebetween.

In fabricating the receptacle 12, the housing 14 may first be formed by a suitable molding operation, with the four rows of apertures being formed during molding, or by a subsequent drilling, punching or similar operation. The terminals 34 are then crimped, soldered, or otherwise connected onto an end of the flexible flat cable 55 in a conventional manner, and so that the tabs 52 are electrically connected to respective ones of the conductors 54 on the cable. Next, the terminals 34 are inserted longitudinally into the chambers 24 by moving the same forwardly through the open rear end 20. Upon reaching their operative position, the retention spring tags 56 of the terminals enter their associated apertures 31, to prevent reverse movement. Also, as best seen in FIG. 11, the forward end portion of the flexible cable 55 will then be disposed in the slots 25 formed in the walls 22 between the chambers 24 of the housing, to limit relative movement of the cable with respect to the housing and the tabs 52.

To connect the completed receptacle to a post header 10 in the manner shown in FIG. 1, the receptacle 12 is placed above the header 10 and then lowered so that the posts 11 enter through the row of apertures 28 in the lower side wall 16. The posts 11 then pass through the area between the contact surfaces 58, 59 and outwardly through the row of apertures 27 in the upper side wall 15. The spacing between the side beams 36, 37 is thereby expanded, causing the beams to firmly engage the posts on the two opposite sides thereof. A similar procedure is followed to assemble the receptacle in the orientation of FIG. 2, but in this case the posts enter through the apertures 27, and then pass outwardly through the apertures 28. In this regard, it will be understood that the apertures 27, 28 of these two rows may be shaped to closely conform to the cross sectional outline of the posts 11, which is square in the illustrated embodiment, and so as to firmly maintain the alignment of the posts with the contact surfaces 58, 59.

In the orientation of FIG. 3, the receptacle 12 is positioned vertically and moved onto the header 10, and so that the posts 11 enter through the apertures 30 in the front end wall 19 and pass longitudinally between the side beams and the two contact surfaces 58, 59. In this latter case, the tongues 47, 48 engage the post to maintain its alignment with the two contact surfaces 58, 59, and preferably these tongues remain in biasing engagement with the post in its completely inserted position, to maintain its alignment with the contact surfaces. Depending upon the length of the posts, the posts may enter between the tongues 49, 50 on the end section 39 to further facilitate and maintain the alignment of the posts with the contact surfaces of the terminal.

Figure 12:
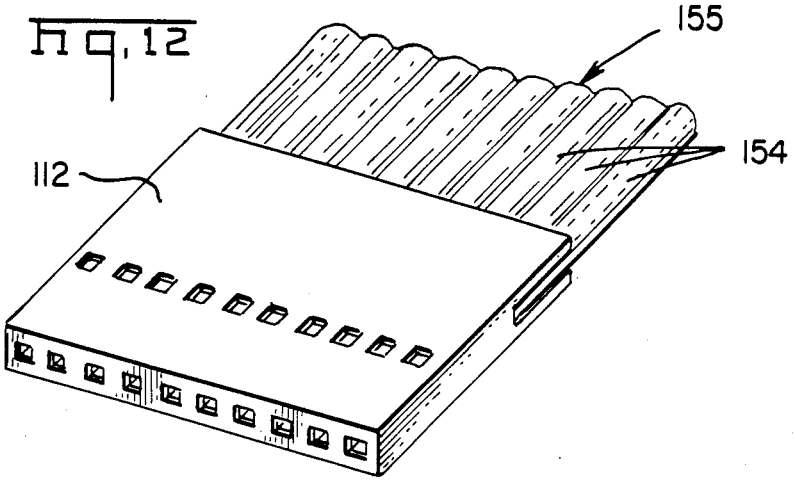
FIG. 12 is a fragmentary perspective view of the receptacle wherein the receptacle is interconnected to an alternative type of cable.
Figure 13:
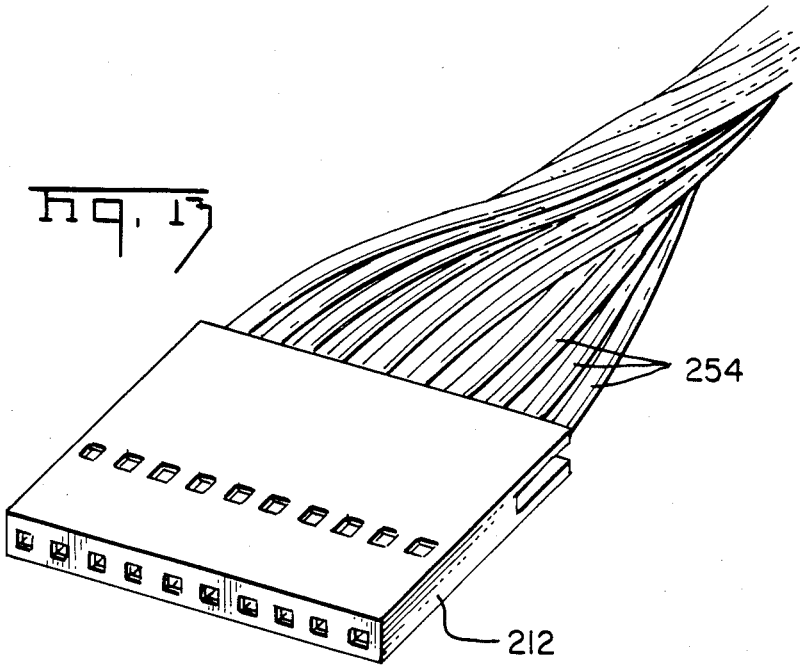
FIG. 13 is a view similar to FIG. 12 wherein the receptacle is interconnected to another alternative type of cable.

FIG. 12 illustrates mating electrical receptacle 112 interconnected with conductors 154 in ribbon cable 155. The terminals are attached to the conductors 154 by means of crimping, solder or other conventional procedure. FIG. 13 illustrates mating receptacle 212 interconnected with discrete wire conductors 255. The terminals 34 are attached to the conductors by means of crimping, soldering, or other conventional procedure.

In the drawings and specification, there has been set forth a preferred embodiment of the invention, and although specific terms are employed, they are used in a generic and descriptive sense only and not for purposes of limitation.

What is claimed is:

1. An electrical terminal adapted to electrically interconnect a conductor with a male post, said terminal having three mating orientations and the ability to mate with the post in any one of said three mating orientations, and comprising a metal member which includes:

a pair of elongate, generally flat side beams disposed in a parallel, laterally spaced-apart relationship, and so as to define a lateral direction extending between said side beams, a longitudinal direction which is parallel to the elongate direction of the side beams, and a transverse direction which is perpendicular to the longitudinal direction and to the lateral direction;

integral connection means interconnecting each pair of adjacent ends of the two side beams; and said side beams each having a contact surface located at a medial location along its length and with the contact surfaces of the two side beams being laterally aligned with each other and indented inwardly toward each other and such that the area between the two contact surfaces is accessible by a post entering therebetween from at least one longitudinal direction and each of the two opposite transverse directions, and with the inwardly indented contact surfaces presenting converging surfaces to facilitate the entry of the past in each of said directions and to cause said side beams to spring apart and resiliently engage the post upon such entry.

2. The electrical terminal as defined in claim 1 wherein said connection means comprises an open box-like end section at each end of said pair of said beams, with each end section being composed of a first pair of opposite side walls which are coextensive with the side beams, and a second pair of opposite side walls.

3. The electrical terminal as defined in claim 2 further comprising an integral tab for electrically connecting a separate conductor thereto, and with said tab extending integrally from one of said side walls of one of said box-like end sections in a longitudinal direction.

4. The electrical terminal as defined in claim 3 wherein one of the side walls of one of said end sections includes an outwardly extending retention spring tab integrally formed therefrom, and so as to be adapted to lock the terminal in a housing having a mating aperture.

5. The electrical terminal as defined in claim 3 wherein each of said side beams has a slightly V-shaped configuration when viewed in a transverse direction, with the V-shaped configuration of the two side beams being oriented oppositely with respect to each other, and with the contact surfaces being disposed at the bights of the V-shaped configuration of the side beams.

6. The electrical terminal as defined in claim 3 wherein said box-like end section opposite said one end section mounting said integral tab, includes a tongue extending longitudinally from each of said second pair of opposite side walls, with the two tongues extending toward said one end section and so as to be adapted to guide a post longitudinally through the associated box-like section.

7. The electrical terminal as defined in claim 6 wherein said tongues are deformed inwardly toward each other, and so as to facilitate their biasing engagement with a post extending therethrough.

8. An electrical receptacle adapted to electrically interconnect each of a plurality of conductors in a cable or the like to respective ones of the posts in a header composed of a row of posts, said receptacle having three mating orientations and the ability to mate with the post header in any one of said three mating orientations, said receptacle comprising:

a housing comprising a plurality of side-by-side enclosed chambers;

electrical terminals mounted in each of said chambers, each of said terminals having three mating orientations and the ability to mate with a post in any one of said three mating orientations, with each of said terminals comprising a metal member which includes (a) a pair of elongate, generally flat side beams disposed in a parallel, laterally spaced apart relationship, and so as to define a lateral direction extending between said side beams, a longitudinal direction which is parallel to the elongate direction of side beams, and a transverse direction which is perpendicular to the longitudinal direction and to the lateral direction, with each of said side beams having a contact surface located at a medial location along its length and so that the contact surfaces are laterally aligned with each other;

(b) integral connection means interconnecting each pair of adjacent ends of the two side beams; and (c) an integral tab extending longitudinally beyond one end of the two side beams for electrically connecting a separate conductor thereto;

said housing including aperture means cooperating with each of said chambers and such that the area between the two contact surfaces of each terminal is accessible by a post entering therebetween from any one of said three mating orientations; and a cable composed of a plurality of parallel conductors, with each of said conductors being electrically connected to respective ones of said tabs of said terminals.

9. The electrical receptacle as defined in claim 8 wherein the cable is a flat flexible cable.

10. The electrical receptacle as defined in claim 8 wherein the cable is a ribbon cable.

11. The electrical receptacle as defined in claim 8 wherein the cable is comprised of discrete wires.

12. The electrical receptacle as defined in claim 8 wherein said housing includes opposite, generally flat side walls disposed on opposite sides of said terminals, and an end wall disposed adjacent the ends of said terminals opposite said tabs, and wherein said aperture means comprises a row of apertures in each of said two side walls, with the two rows being transversely aligned with each other and with the area between the contact surfaces of the terminals and such that the posts of a post header may be inserted transversely through either of said rows of apertures so as to pass between and engage the contact surfaces of the rspective terminals.

13. The electrical receptacle as defined in claim 12 wherein said aperture means further comprises a third row of apertures disposed on said end wall of said housing, with said third row of apertures being longitudinally aligned with the area between the contact surfaces of the terminals and such that the posts of a post header may be inserted longitudinally through said third row of apertures and so as to pass between and engage the contact surfaces of the respective terminals.

14. The electrical receptacle as defined in claim 13 wherein the contact surfaces of the two side beams are indented inwardly toward each other, and such that the inwardly indented contact surfaces present converging surfaces to facilitate the entry of said posts between the respective pairs of the contact surfaces in each of the three orientations.

15. The electrical receptacle as defined in claim 13 wherein each of said terminals further includes an outwardly extending retention spring tab, and one of said two side walls of said housing includes a further row of apertures, with each such aperture communicating with one of said chambers and being adapted to receive the retention spring tab of the associated terminal to retain the terminal therein.

* * * * *